US006305388B1

(12) United States Patent
Zeller

(10) Patent No.: US 6,305,388 B1
(45) Date of Patent: Oct. 23, 2001

(54) PORTABLE HAIR SALON STATION

(76) Inventor: Richard D. Zeller, 121 S. Hampton Rd. #72, Crowley, TX (US) 76136

( * ) Notice: Subject to any disclaimer, the term of this patent is extended or adjusted under 35 U.S.C. 154(b) by 0 days.

(21) Appl. No.: 09/426,160

(22) Filed: Oct. 22, 1999

(51) Int. Cl.[7] ..... A45D 40/24; A45D 40/00

(52) U.S. Cl. ..... 132/314; 132/287

(58) Field of Search ..... 132/314, 73.5, 132/74.5, 75, 287, 294, 297; 362/154, 155

(56) References Cited

U.S. PATENT DOCUMENTS

| | | | | |
|---|---|---|---|---|
| 279,302 | * | 6/1883 | Wolf | 132/314 |
| 2,180,151 | * | 11/1939 | Koeller | 132/287 |
| 5,992,422 | * | 11/1999 | Ivory | 132/73 |

* cited by examiner

*Primary Examiner*—John J. Wilson
*Assistant Examiner*—Robyn Kieu Duan

(57) ABSTRACT

A portable hair salon station for maintaining a clean work station and for preventing the entanglement of power cords. The portable hair salon station includes a multi-sided box-like member having a plurality of slots in an upper/frontal side and further having a plurality of rotatable shafts journaled to and disposed inside the box-like member, and a plurality of spring-loaded spools wound with electrical power cords and being mounted about the shafts. Each electrical power cord has an adapter outlet plug connected to an exposed end thereof, and is extended and unwindable through a respective slot. A plurality of cylindrical containers each having an open top and a closed bottom and an arcuate lip about the top, are removeably disposed in designated slots for receiving and storing certain hair implements. In addition, there are two slots each of which is disposed proximately to a slot for an outlet plug and each of which has a latch member slidably disposed therein and engageable to a respective outlet plug. Also, there are a pair of electrical outlet members disposed in a lower front side of the box-like member.

17 Claims, 4 Drawing Sheets

PORTABLE HAIR SALON STATION

BACKGROUND OF THE INVENTION

1. Field of the Invention

The present invention relates to storage and plug-in outlets for hair implement devices and more particularly pertains to a new portable hair salon station for maintaining a clean work station and for preventing the entanglement of power cords.

2. Description of the Prior Art

The use of storage and plug-in outlets for hair implement devices is known in the prior art. More specifically, storage and plug-in outlets for hair implement devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,547,393; U.S. Pat. No. 5,124,532; U.S. Pat. No. D256,637; U.S. Pat. No. 3,566,332; U.S. Pat. No. D360,282; and U.S. Pat. No. 5,054,615.

While these devices fulfill their respective, particular objectives and requirements, the aforementioned patents do not disclose a new portable hair salon station. The inventive device includes a multi-sided box-like member having a plurality of slots in an upper/frontal side and further having a plurality of rotatable shafts journaled to and disposed inside the box-like member, and a plurality of spring-loaded spools wound with electrical power cords and being mounted about the shafts. Each electrical power cord has an adapter outlet plug connected to an exposed end thereof, and is extended and unwindable through a respective slot. A plurality of cylindrical containers each having an open top and a closed bottom and an arcuate flange about the top, are removeably disposed in a selected number of slots for receiving and storing certain hair tools. In addition, there are two recesses each of which is disposed proximately to a slot for a respective outlet plug and each of which has a latch member slidably disposed therein and engageable to a respective outlet plug. Also, there are a pair of electrical outlet members disposed in a lower front side of the box-like member.

In these respects, the portable hair salon station according to the present invention substantially departs from the conventional concepts and designs of the prior art, and in so doing provides an apparatus primarily developed for the purpose of maintaining a clean work station and for preventing the entanglement of power cords.

SUMMARY OF THE INVENTION

In view of the foregoing disadvantages inherent in the known types of storage and plug-in outlets for hair implement devices now present in the prior art, the present invention provides a new portable hair salon station construction wherein the same can be utilized for maintaining a clean work station and for preventing the entanglement of power cords.

The general purpose of the present invention, which will be described subsequently in greater detail, is to provide a new portable hair salon station which has many of the advantages of the storage and plug-in outlets for hair implement devices mentioned heretofore and many novel features that result in a new portable hair salon station which is not anticipated, rendered obvious, suggested, or even implied by any of the prior art storage and plug-in outlets for hair implement devices, either alone or in any combination thereof.

To attain this, the present invention generally comprises a multi-sided box-like member having a plurality of slots in an upper/frontal side and further having a plurality of rotatable shafts journaled to and disposed inside the box-like member, and a plurality of spring-loaded spools wound with electrical power cords and being mounted about the shafts. Each electrical power cord has an adapter outlet plug connected to an exposed end thereof, and is extended and unwindable through a respective slot. A plurality of cylindrical containers each having an open top and a closed bottom and an arcuate flange about the top, are removeably disposed in a selected number of slots for receiving and storing certain hair tools. In addition, there are two recesses each of which is disposed proximately to a respective slot for an outlet plug and each of which has a latch member slidably disposed therein and engageable to a respective outlet plug. Also, there are a pair of electrical outlet members disposed in a lower front side of the box-like member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable hair salon station which has many of the advantages of the storage and plug-in outlets for hair implement devices mentioned heretofore and many novel features that result in a new portable hair salon station which is not anticipated, rendered obvious, suggested, or even implied by any of the prior art storage and plug-in outlets for hair implement devices, either alone or in any combination thereof.

It is another object of the present invention to provide a new portable hair salon station which may be easily and efficiently manufactured and marketed.

It is a further object of the present invention to provide a new portable hair salon station which is of a durable and reliable construction.

An even further object of the present invention is to provide a new portable hair salon station which is susceptible of a low cost of manufacture with regard to both materials and labor, and which accordingly is then susceptible of low prices of sale to the consuming public, thereby making such portable hair salon station economically available to the buying public.

Still yet another object of the present invention is to provide a new portable hair salon station which provides in the apparatuses and methods of the prior art some of the advantages thereof, while simultaneously overcoming some of the disadvantages normally associated therewith.

Still another object of the present invention is to provide a new portable hair salon station for maintaining a clean work station and for preventing the entanglement of power cords.

Yet another object of the present invention is to provide a new portable hair salon station which includes a multi-sided box-like member having a plurality of slots in an upper/frontal side and further having a plurality of rotatable shafts journaled to and disposed inside the box-like member, and a plurality of spring-loaded spools wound with electrical power cords and being mounted about the shafts. Each electrical power cord has an adapter outlet plug connected to an exposed end thereof, and is extended and unwindable through a respective slot. A plurality of cylindrical containers each having an open top and a closed bottom and an arcuate flange about the top, are removeably disposed in a selected number of slots for receiving and storing certain hair implements. In addition, there are two slots each of which is disposed proximately to a respective slot for an outlet plug and each of which has a latch member slidably disposed therein and engageable to a respective outlet plug. Also, there are a pair of electrical outlet members disposed in a lower front side of the box-like member.

Still yet another object of the present invention is to provide a new portable hair salon station that essentially forces the user to keep his/her work station neatly organized and cleaned.

Even still another object of the present invention is to provide a new portable hair salon station that prevents the user from tripping over hanging and dangling cords.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
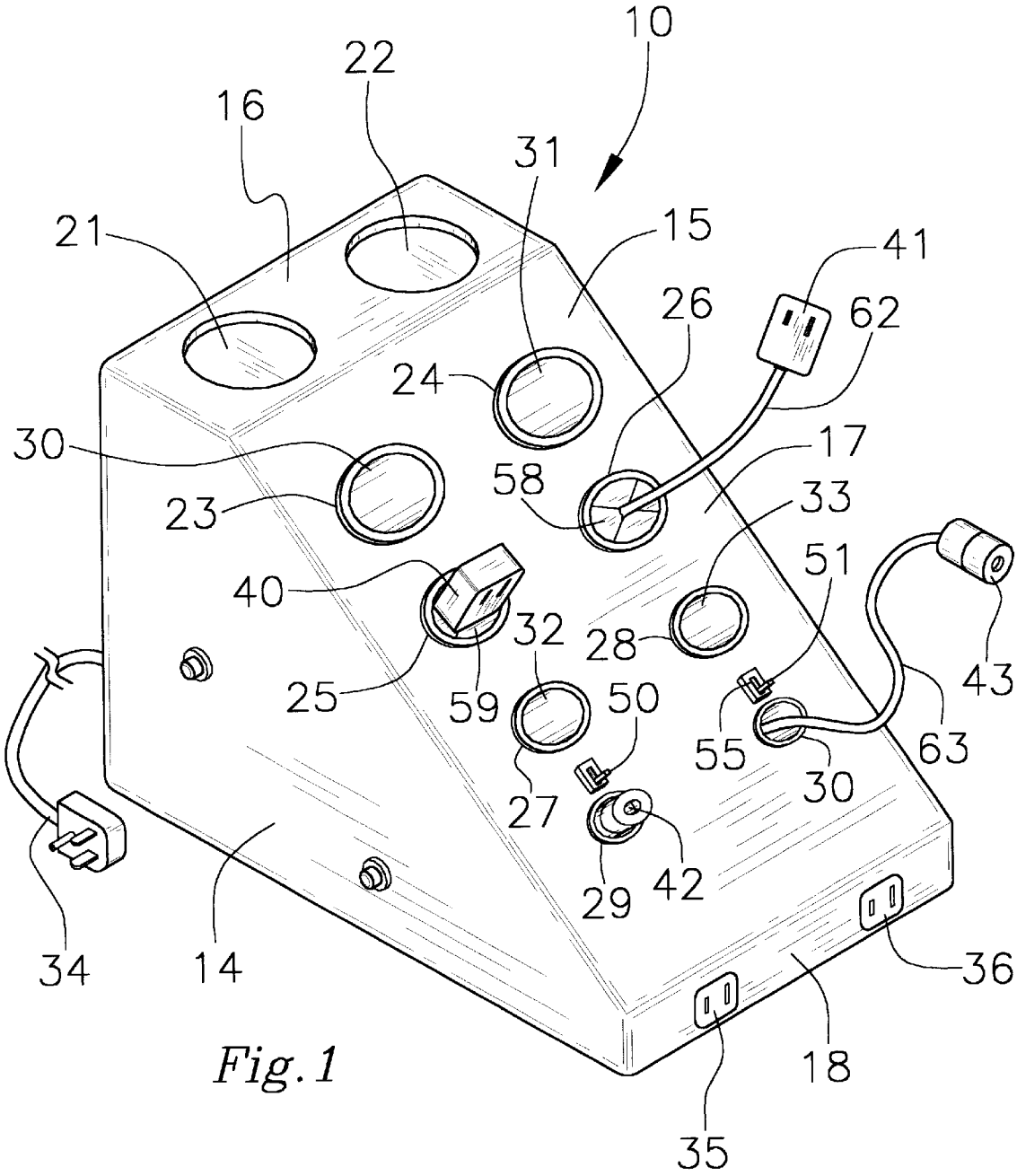
FIG. 1 is a perspective view of a new portable hair salon station according to the present invention.
Figure 2:
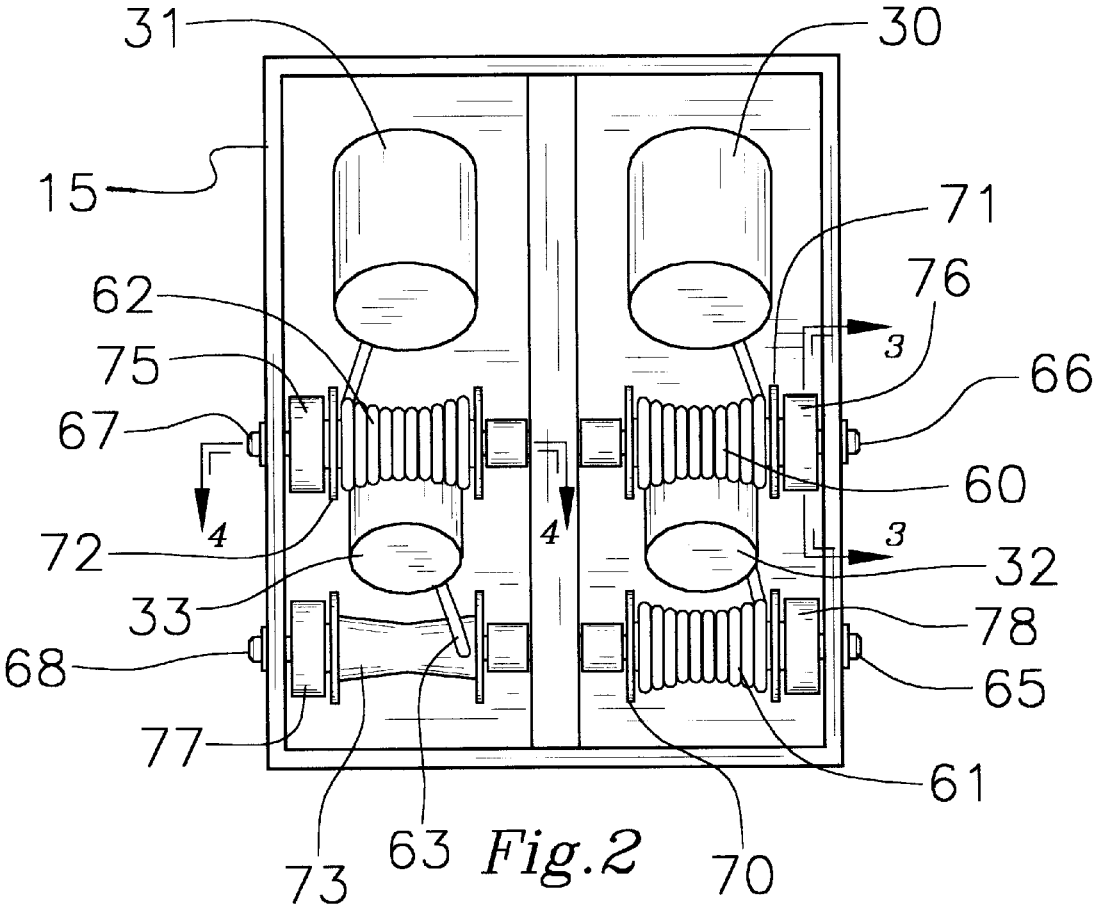
FIG. 2 is a rear cross-sectional view of the present invention.
Figure 3:
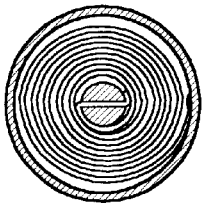
FIG. 3 is a detailed side elevational view of a torsion spring of the present invention.
Figure 4:
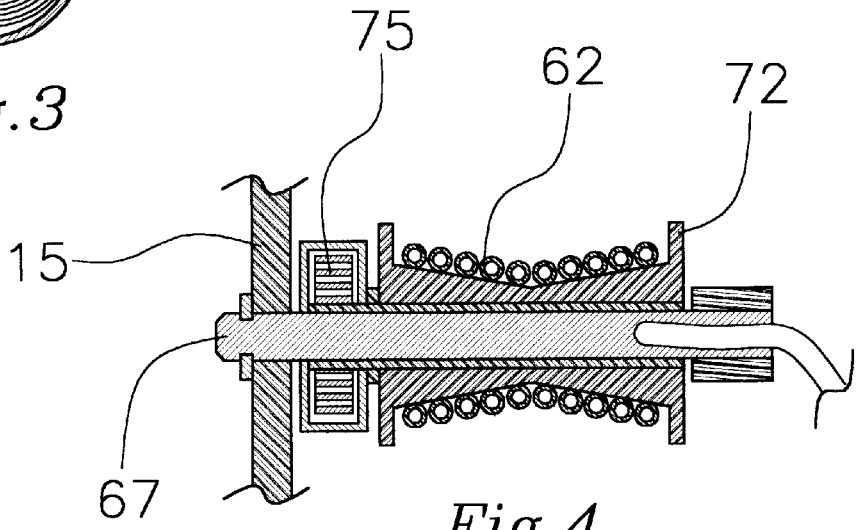
FIG. 4 is a detailed cross-sectional view of a shaft and spool and power cord of the present invention.
Figure 5:
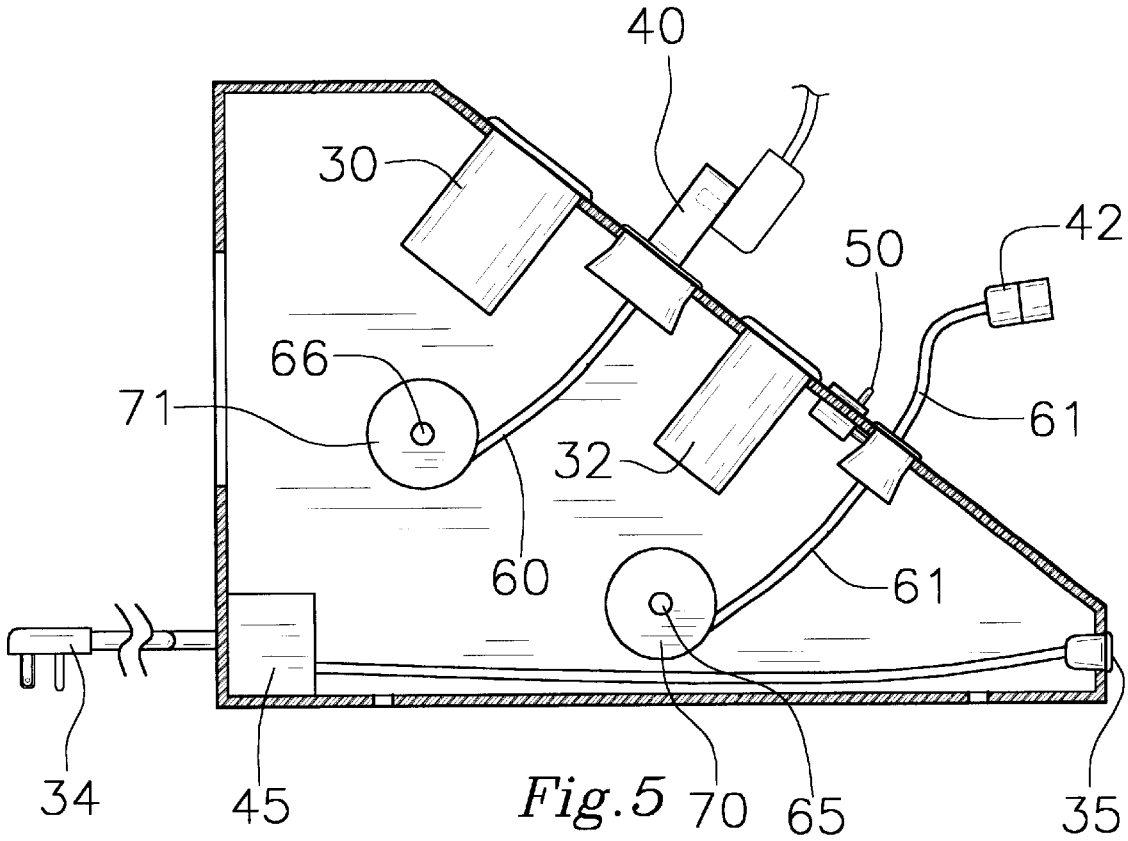
FIG. 5 is a side cross-sectional view of the present invention.
Figure 6:
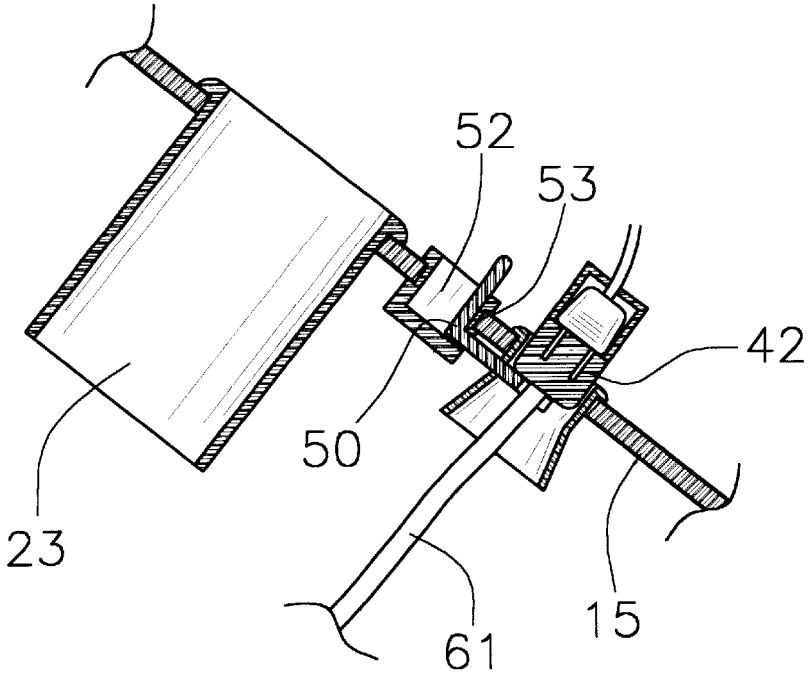
FIG. 6 is a detailed side cross-sectional view the latch member of the present invention.
Figure 7:
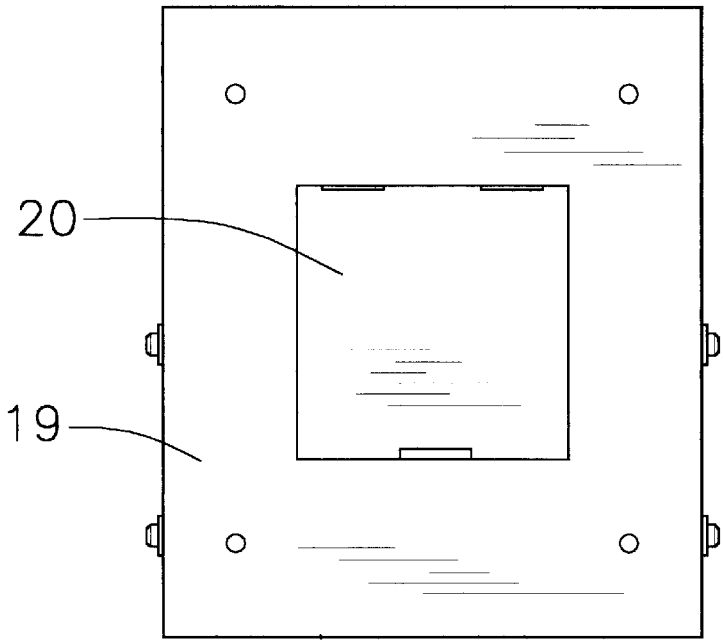
FIG. 7 is rear elevational view of the present invention.
Figure 8:
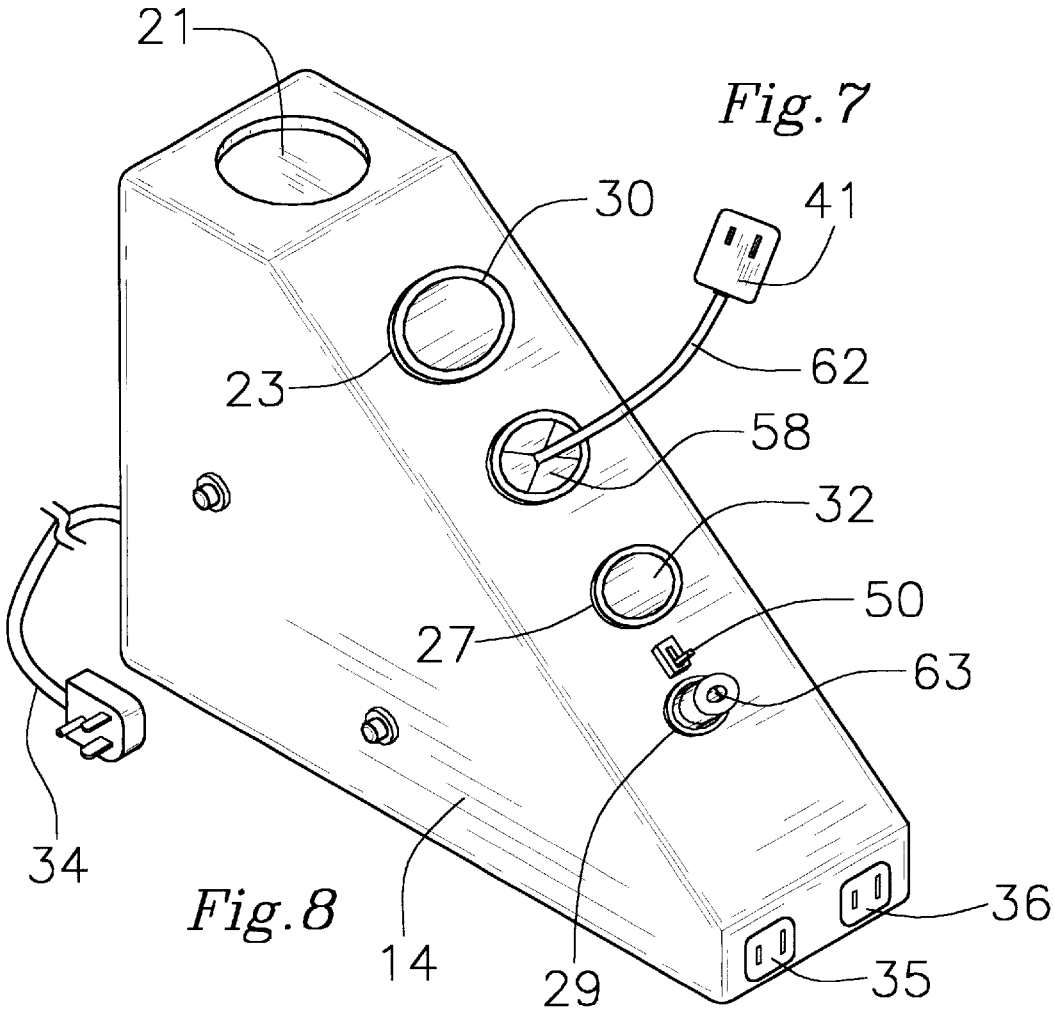
FIG. 8 is a perspective view of another embodiment of the present invention.

With reference now to the drawings, and in particular to FIGS. 1 through 8 thereof, a new portable hair salon station embodying the principles and concepts of the present invention and generally designated by the reference numeral 10 will be described.

As best illustrated in FIGS. 1 through 8, the portable hair salon station 10 generally comprises a box-like member 15 having multiple sides including a slanted upper/frontal side 17, a back side 19, a top 16, a front 18, left and right sides 14, and a bottom, the box-like member 15 having a door 20 disposed in back side 19 and having a plurality of slots 21–30 therein, the slots 21–30 being disposed in the top 16, the upper/frontal side 17, and the front 18 of the box-like member 15, the upper/frontal side 17 being angled relative to the top 16 and the front 18;

The hair salon station 10 further includes four containers 30–33 each having a closed bottom, an open top and an arcuate flange about the top, the containers 30–33 being removeably disposed in a selected number of slots 23,24, 27,28. The arcuate flanges are adapted to rest upon the upper/frontal side 17 about the selected number of slots 23,24,27,28 when the containers 30–33 are disposed therein. The containers 30–33 include two large containers 30,31 for receiving and storing larger hair tools such as a hair dryer and a scissors and also including two small containers 32,33 for receiver and storing smaller hair tools such as hair clippers and combs. In addition, the hair salon station 10 includes four rotatable shafts 65–68 conventionally journaled to and disposed inside the box-like member 15, four spring-loaded spools 70–73 mounted about the shafts 65–68, four power cords 60–63 removeably wound about respective the spools 70–73 and being extendable through four of the slots 25,26,29,30, a means for locking two of the power cords 61,63 in their respective slots 29,30, two power outlet members 35,36 disposed in the front 18 of the box-like member 15 near a bottom thereof, a conventional power access unit connected 45 to the two power outlet members 35,36 and to the four power cords 60–63, and an electrical cord 34 connected to the conventional power access unit 45 and adapted to be plugged into an electrical outlet for obtaining electricity. Each of the power cords 60–63 includes an exposed end having an adapter outlet plug 40–43 connected thereto. The adapter outlet plugs 40–43 are exposed to an outside of the box-like member 15 for easy and convenient access with each of the power cords 60–63 being removably wound about a respective one of the spring-loaded spools 70–73 and is retractably extended through a respective one of the selected number of slots 25,26,29,30. Each of the spring-loaded spools 70–73 is disposed adjacent to a respective one of the slots 25,26,29,30 through which the respective one of the power cords 60–63 is retractably extended. The spring-loaded spools 70–73 include four torsion springs 75–78 mounted about the shafts 65–68. The means for locking a selected number of the power cords 61,63 include two recesses 52,55 disposed in the upper/frontal side 17, each recess 52,55 having a side wall 53 and an opening therethrough, and further including two slidable latch members 50,51 disposed in respective recesses 52,55 and slidably extended through the side walls 53. Each of the slidable latch members 50,51 is adapted to engage a respective one of the adapter outlet plugs 42,43 disposed through the respective one of the selected number of slots 29,30 with each of the slidable latch members 50,51 being essentially L-shaped. The box-like member 15 includes two flexible membranes 58,59 openably disposed over respective slots 25,26 to essentially prevent foreign substances from entering the box-like member 15.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable hair salon station comprising:

a box-like member having multiple sides including a slanted upper/frontal side, a back side, a top, a front, left and right sides, and a bottom, said box-like member having a plurality of slots therein;

a plurality of containers each having a closed bottom, an open top and an arcuate flange at said top, said containers being removeably disposed in a selected number of said slots;

a means for providing access to power disposed in said box-like member; wherein said means for providing access to power includes:

a plurality of rotatable shafts journaled to and disposed inside said box-like member;

a plurality of spring-loaded spools mounted about said shafts;

a plurality of power cords removeably wound about said spools and being extendable through a selected number of said slots;

a means for locking a selected number of said power cords in their respective said slots;

at least one power outlet member disposed in one of said sides of said box-like member;

a power access unit connected to said at least one power outlet member and to said power cords; and an electrical cord connected to said power access unit and adapted to be plugged into an electrical outlet for obtaining electricity.

2. A portable hair salon station as described in claim 1, wherein said slots are disposed in said top, said upper/frontal side, and said front of said box-like member.

3. A portable hair salon station as described in claim 1, wherein said upper/frontal side is angled relative to said bottom and said front.

4. A portable hair salon station as described in claim 1, wherein said arcuate flanges are adapted to rest upon said upper/frontal side about said selected number of said slots when said containers are disposed therein.

5. A portable hair salon station as described in claim 1, wherein said containers include large containers for receiving and storing larger hair tools such as a hair dryer and a scissors and also include small containers for receiver and storing smaller hair tools such as hair clippers and combs.

6. A portable hair salon station as described in claim 1, wherein each of said power cords has an exposed end having an adapter outlet plug connected thereto, said adapter outlet plug being exposed to an outside of said box-like member for easy and convenient access.

7. A portable hair salon station as described in claim 1, wherein each of said power cords is removably wound about a respective one of said spring-loaded spools and is retractably extended through a respective one of said selected number of said slots.

8. A portable hair salon station as described in claim 1, wherein each of said spring-loaded spools carrying a respective one of said power cords is disposed adjacent to a respective one of said slots.

9. A portable hair salon station as described in claim 1, wherein said spring-loaded spools include torsion springs mounted about said shafts.

10. A portable hair salon station as described in claim 6, wherein said means for locking a selected number of said power cords includes at least one recess disposed in said upper/frontal side and having a side wall and an opening therethrough, and further includes at least one slidable latch member disposed in said at least one recess and slidably extended through said side wall thereof.

11. A portable hair salon station as described in claim 10, wherein said at least one slidable latch member is adapted to engage one of said adapter outlet plugs disposed through said respective one of said selected number of said slots.

12. A portable hair salon station as described in claim 10, wherein said at least one slidable latch member is essentially L-shaped.

13. A portable hair salon station as described in claim 1, wherein said box-like member includes at least one flexible membrane openably disposed over a respective one of said slots to essentially prevent foreign substances from entering said box-like member.

14. A portable hair salon station comprising:

a box-like member having multiple sides including a slanted upper/frontal side, a back side, a top, a front, left and right sides, and a bottom, said box-like member having a door in said back side and having a plurality of slots therein, said slots being disposed in said top, said upper/frontal side, and said front of said box-like member, said upper/frontal side being angled relative to said bottom and said front;

four containers each having a closed bottom, an open top and an arcuate flange about said top, said containers being removeably disposed in a selected number of said slots, said arcuate flanges being adapted to rest upon said upper/frontal side about said selected number of said slots when said containers are disposed therein, said containers including two large containers for receiving and storing larger hair tools such as a hair dryer and a scissors and also including two small containers for receiver and storing smaller hair tools such as hair clippers and combs; and a means for providing access to power disposed in said boxlike member and including four rotatable shafts conventionally journaled to and disposed inside said box-like member, four spring-loaded spools mounted about said shafts, four power cords removeably wound about respective said spools and being extendable through four of said slots, a means for locking two of said power cords in their respective said slots, two power outlet members disposed in said front side of said box-like member near a bottom thereof, a conventional power access unit connected to said two power outlet members and to said four power cords, and an electrical cord connected to said power access unit and adapted to be plugged into an electrical outlet for obtaining electricity, each of said power cords including an exposed end having an adapter outlet plug connected thereto, said adapter outlet plug being exposed to an outside of said box-like member for easy and convenient access, each of said power cords being removably wound about a respective one of said spring-loaded spools and is retractably extended through a respective one of said selected number of said slots, each of said spring-loaded spools being disposed adjacent to a respective one of said slots through which said respective one of said power cords is retractably extended, said spring-loaded spools including four torsion springs mounted about said shafts, said means for locking a selected number of said power cords including two recesses disposed in two of said respective said slots each having a side wall and an opening therethrough, and further including two slidable latch members disposed in respective said recesses and slidably extended through said side walls, each of said slidable latch member being adapted to engage a respective one of said adapter outlet plugs disposed through said respective one of said selected number of said slots, each of said slidable latch members being essentially L-shaped, said box-like member including two flexible membranes openably disposed over respective said slots to essentially prevent foreign substances from entering said box-like member.

15. A portable hair salon station comprising:

a housing having multiple sides including an upper/frontal side, a back side, a top, a front, left and right sides, and a bottom, said housing having a plurality of slots therein;

a plurality of containers each having a closed bottom, an open top and an arcuate flange at said top, said containers being removeably disposed in a selected number of said slots;

a means for providing access to power being disposed in said housing, wherein said means for providing access to power includes:

a plurality of rotatable shafts mounted in said housing;

a plurality of spools mounted about said shafts;

a plurality of power cords wound about said spools, each of said plurality of cords being retractably extendable through one of said slots;

a means for retracting at least one of said power cords into said housing, said means being associated with at least one of said spools for causing rotation of said spool in a manner retracting the power cord wound about said spool into said housing;

a means for selectively locking at least one of said spools against rotation of said spool by said means for retracting;

at least one power outlet member disposed in one of said sides of said housing;

an electrical cord electrically connected to each of said power cords and being adapted to be plugged into an electrical outlet for obtaining electricity;

wherein each of said power cords has a free end having an outlet plug connected thereto.

16. A portable hair salon station as described in claim 15, wherein a said means for retracting and a said means for selectively locking is provided for each of said spools and power cords.

17. A portable hair salon station as described in claim 15, wherein said means for retracting includes a torsion spring mounted about said shaft.

* * * * *